US005952907A

United States Patent [19]

McWilliams et al.

[11] Patent Number: 5,952,907

[45] Date of Patent: Sep. 14, 1999

[54] BLIND HOLE POT CORE TRANSFORMER DEVICE

[75] Inventors: Michael D. McWilliams, Oceanside; Russell L. Machado, San Diego, both of Calif.

[73] Assignee: Pulse Engineering, Inc., San Diego, Calif.

[21] Appl. No.: 08/834,997

[22] Filed: Apr. 7, 1997

[51] Int. Cl.[6] ..... H01F 27/26

[52] U.S. Cl. ..... 336/83; 336/210; 336/212

[58] Field of Search ..... 336/83, 210, 212; 24/706, 707.4, 297; 411/513, 514

[56] References Cited

U.S. PATENT DOCUMENTS

| | | | |
|---|---|---|---|
| 1,142,471 | 6/1915 | White | 411/514 |
| 1,953,035 | 3/1934 | Wyss . | |
| 2,560,926 | 7/1951 | Brownell . | |
| 3,060,353 | 10/1962 | Shansky et al. . | |
| 3,215,905 | 11/1965 | Bloom . | |
| 3,287,678 | 11/1966 | Okamoto et al. . | |
| 3,609,615 | 9/1971 | Parker et al. . | |
| 3,629,759 | 12/1971 | Douglas et al. . | |
| 3,680,018 | 7/1972 | Elberger . | |
| 4,754,250 | 6/1988 | Duin . | |
| 4,806,064 | 2/1989 | Breese | 411/514 |
| 5,028,905 | 7/1991 | Lostumo . | |
| 5,489,884 | 2/1996 | Heringer et al. . | |

FOREIGN PATENT DOCUMENTS

| | | | |
|---|---|---|---|
| 2406353A1 | 8/1975 | Germany | 336/83 |

*Primary Examiner*—Thomas J. Kozma
*Attorney, Agent, or Firm*—Knobbe, Martens, Olson & Bear LLP

[57] ABSTRACT

A blind hole pot core transformer comprised of a base member having a toroidal channel with a central post and a cover member also having a toroidal channel with a central post. A bobbin winding is positioned within a cavity defined by the toroidal channels of the base and cover members with a core comprised of the central posts of the base and cover member positioned within an opening in the bobbin winding. A compressible alignment member is positioned within an opening formed on outer mating surfaces of the central posts of both the base and cover members to retain the base and cover members in a desired orientation with respect to each other. The compressible alignment member has a cross-sectional area that is greater than the openings in the base and cover members so that any gap between the alignment member and the inner walls of at least one of the openings is eliminated thereby facilitating alignment between the central posts comprising the core of the device.

13 Claims, 3 Drawing Sheets

BLIND HOLE POT CORE TRANSFORMER DEVICE

BACKGROUND OF THE INVENTION

1. Field of the Invention

The present invention relates to a pot core transformer and, in particular, a pot core transformer comprised of two halves wherein both of the halves have posts that form the center of the core of the transformer and the posts have holes formed therein that receive an alignment member wherein the alignment member facilitates correct alignment of the two halves of the transformer core.

2. Description of the Related Art

Transformers, and in particular pot core transformers, are commonly used in computer circuits and in communication circuits. These types of devices are used for impedance matching and also for isolation purposes to ensure that data and communication signals within networks are accurately transferred along the network. One such application of these devices is for isolation purposes in ISDN networks.

For these types of applications, it is important that the pot core transformer have inductances that are within very exact tolerances. For example, it is desirable that each pot core transformer have an inductance that is within ±5% of the nominal inductance of the device. In these applications, the nominal inductance is typically on the order of 20 to 50 mH. Consequently, great care must be taken during the assembly of the pot core transformer to ensure that the device has an inductance within the desired tolerances.

U.S. Pat. No. 3,609,615 to Parker et al. discloses a typical pot core transformer device. As shown, the pot core transformer device has a casing that forms a core that is comprised of two halves, each of which defines a cylindrical opening with a center post extending in the middle of the cylindrical opening. Further, there is a bobbin assembly upon which the windings of the transformer are wound. The bobbin assembly fits within the cylindrical openings of the two halves with the posts centered inside of the bobbin. Hence, the two halves form the core of the transformer which permits transfer of magnetic flux from the primary winding to the secondary winding on the bobbin assembly.

As shown in U.S. Pat. No. 3,609,615, the two halves of the core are then connected together by positioning a screw or bolt so as to extend through an opening formed in both halves of the core. The bolt preferably extends through the center of the posts on either half of the core and is then tightened against a nut to secure the halves of the core together. An adhesive is positioned on the mating surfaces of the two halves of the core and the two halves of the core remain secured together by the bolt and nut while the adhesive dries. The bolt is apparently tightened while the inductance of the device is simultaneously monitored until a desired inductance reading is obtained. Once the adhesive dries, the nut and bolt are then removed and the device is completed.

The pot core transformer illustrated and described in U.S. Pat. No. 3,609,615 describes the typical pot core transformer that is currently in use. There are some disadvantages of this type of pot core transformer and the above-described assembly method. In particular, the assembly method is expensive as the bolt has to be positioned within the pot core and secured with the nut so that the two halves of the pot core casing can be connected together. This task is often performed by hand which results in a relatively expensive assembly step. There is, of course, additional assembly expense in removing this nut and bolt once the adhesive has dried. Moreover, since it is typically desirable that the outer surfaces of the pot core transformer be relatively smooth, the holes that receive the bolt must then be filled at additional expense. Consequently, these types of pot core transformers have a relatively high assembly cost.

Further, these types of pot core transformers are often difficult to assemble while maintaining the inductance of the device in close tolerance with the nominal or desired inductance. In particular, it is understood that the cross-sectional area of the core, and, in particular, the center of the core comprised of the two posts positioned adjacent to each other, has a significant value on the overall inductance of the device. Consequently, even slight misalignment of the two posts can result in a change in the effective cross-sectional area of the core which can result in variations of the inductance of the device. This misalignment can be the result of the manufacturing tolerances of the openings that receive the bolt or the manufacturing tolerances of the bolt itself. During tightening, a gap between the bolt and the inner walls of the openings can result in slight lateral movement between the two halves of the core. This can, in turn, result in one post being slightly misaligned with the other post thereby altering the effective cross-sectional area of the core and affecting the inductance of the device.

In U.S. Pat. No. 3,609,615, the bolt and nut are tightened while the inductance is simultaneously being measured. Hence, the effect of misalignment of the two posts on the inductance is less of a problem when the inductance is being simultaneously measured. However, simultaneously measuring the inductance while assembling the device is expensive from a manufacturing standpoint and is not generally feasible for devices that are mass produced.

Typically, for mass produced devices, the screw and the nut are tightened to a preset degree which is expected to yield a particular desired inductance. Alignment between the two posts comprising the core is basically performed by the assembler assembling the two halves together by hand in close proximity to each other. Hence, alignment between the two halves of the core is not very precise and is subject to misalignment resulting from the manufacturing tolerances of the device and the skill of the assembler. This results in pot core transformers having actual inductances that may vary widely from the desired inductance of the device.

A further difficulty with pot core transformer devices that are similar to the device disclosed in U.S. Pat. No. 3,609,615, is that the opening that receives the bolt can disrupt the smooth upper surface of the device, even if it is subsequently filled. Typically, when this opening is filled, there still is a divot that remains. In the assembly of many PC boards, vacuum placement devices are used to automate the assembly process. However, the divot that often remains in many prior art pot core transformers can result in the vacuum placement device not being able to securely capture the transformer and place it on a PC board. Further, while there are some other pot core transformers that do not have the alignment holes described above, alignment and assembly of these devices are complicated.

From the foregoing, it should be apparent that there is a need for a pot core transformer device wherein the assembly of the pot core transformer device is simplified. To this end, there is a need for a device which facilitates the alignment between the two halves of the pot core transformer device so that the two halves of the core are more precisely aligned. Lastly, there is a need for a pot core transformer device that can be assembled so as to have close alignment between the posts comprising the core, which still has a planer top surface to facilitate vacuum placement of the device on a printed circuit board.

SUMMARY OF THE INVENTION

The aforementioned needs are satisfied by the present invention which is comprised of an electrical device having a bobbin winding that is positioned within a transformer pot core. The pot core is comprised of a first member which has a first bobbin channel and a second member which has a second bobbin channel wherein the first and second members retain the bobbin winding within a cavity defined by the channels when the first and second members are retained in a first orientation with respect to each other. The center post of the core is centered in the bobbin channels in both the first and second members thus forming the center of the core of the transformer. An alignment member is positioned in both the first member and the second member to retain the device in the first orientation. Hence, the device can be assembled by positioning the bobbin winding in one of the bobbin chambers and then positioning the alignment member in the opening on one of the members. The other member is then positioned on the alignment member which preferably retains the first and second members in the first orientation.

Preferably, once the two members are positioned adjacent one another, the members are secured to each other. In the preferred embodiment, an adhesive is attached to the mating surfaces of the first and second member so as to retain the first and second members together.

In one aspect of the present invention, the alignment member is slightly larger in cross-section than the opening in the second member but the alignment member is compressible. When the alignment member is positioned within the opening in the second member, the alignment member compresses to thereby permit the alignment member to be fully positioned within the opening in the second member.

In the preferred embodiment, the posts on both the first and second members have a first cross-sectional area at their mating surfaces. Further, the alignment member and opening in the second member are configured so that when the alignment member is positioned within the opening in the second member the mating surfaces of the posts are aligned so that the core has a substantially uniform cross-sectional area.

Since the alignment member has a cross-sectional area that is greater than the cross-sectional area of the opening in the second member but is compressible to fit within the opening, the effect on misalignment due to the manufacturing tolerances of both the alignment member and the opening in the second member is reduced. Specifically, the opening in the second member and the alignment member may not be exactly the desired dimensions to achieve optimal alignment between the two posts comprising the core. However, ensuring that the compressible alignment member has a greater cross-sectional area than the largest possible cross-sectional area of the opening, given the manufacturing tolerance of the opening, results in the compressible alignment member being positioned in the opening with the outer surfaces of the alignment member touching the inner surfaces of the opening. Consequently, the second member is less likely to move with respect to the first member as a result of a gap between the alignment member and the inner surface of the opening in the second member.

It will be appreciated that the electronic device having the configuration of the present invention simplifies assembly of the electronic device and also ensures greater alignment of the two center posts of the core of the electronic device. This results in a device which is less expensive to manufacture and also has electrical properties that are closer to the nominal or preferred properties of the device. These and other objects and advantages of the present invention will become more apparent from the following description taken in conjunction with the accompanying drawings.

DETAILED DESCRIPTION OF THE PREFERRED EMBODIMENT

Figure 1:
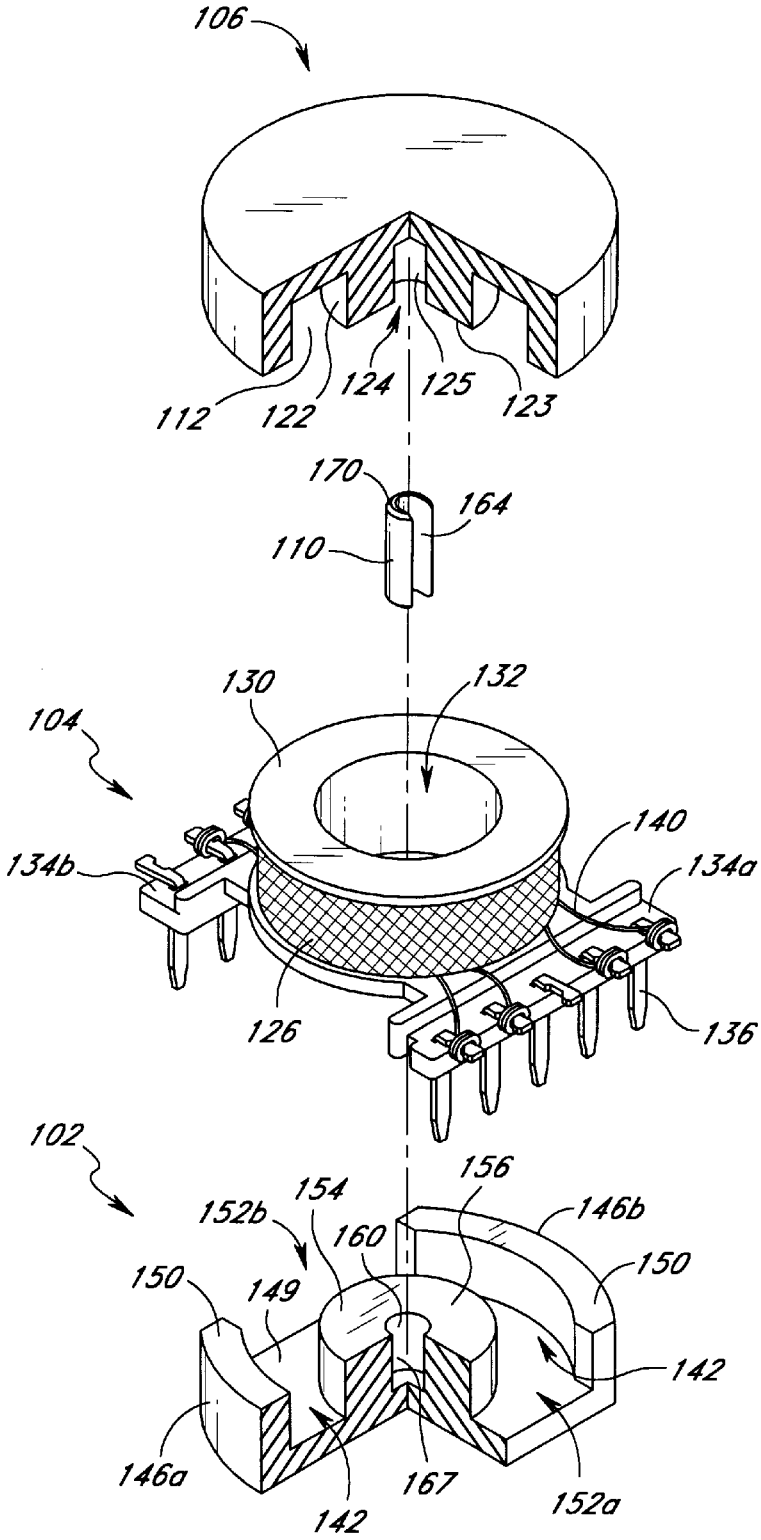
FIG. 1 is an exploded perspective view of an electronic device incorporating the alignment assembly of the preferred embodiment.

Reference will now be made to the drawings wherein like numerals refer to like parts throughout. Referring initially to FIG. 1, the components of the electrical device 100 are shown. In this embodiment, the electrical device 100 is comprised of a pot core transformer. In particular, the pot core transformer 100 is comprised of a base member 102, a bobbin winding assembly 104 and a cover member 106. The bobbin winding assembly 104 is configured to be positioned in the base member 102 and the cover member 106 is configured to be positioned adjacent the base member 102 with the bobbin winding assembly 104 positioned between the base member 102 and the cover member 106. Further, as shown in FIG. 1, the pot core transformer 100 includes an alignment member 110 that ensures proper alignment between the base member 102 and the cover member 106 after the device 100 has been assembled.

Figure 2:
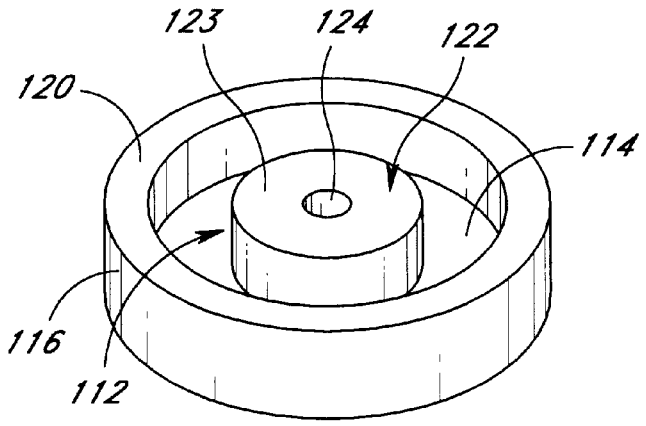
FIG. 2 is a bottom perspective view of a cover member of the electrical device of FIG. 1.

In FIG. 1, the base member 102 and the cover member 106 have been partially cut away to illustrate the configuration of these members. In particular, the cover member 106 includes a toroidal channel 112 that is sized so as to receive the bobbin winding assembly 104. In particular, as shown in FIG. 2, the cover member 106 includes a lip 116 which extends from a circular inner surface 114 and terminates in a flat outer mating surface 120. Further, a cylindrical post 122 also extends from the inner surface 114 of the cover member 106 so that the toroidal channel 112 is defined between the inner surfaces of the lip 120 and the outer surfaces of the cylindrical post 122.

The cylindrical post 122 is preferably centered about the center point of the circular inner surface 114 of the cover member 106. Further, the post 122 terminates in a flat mating surface 123 and an opening 124 is formed in the mating surface 123 of the post 122 and is preferably located at the center of the post 122. The opening 124 is shown in both FIGS. 1 and 2, and in FIG. 1, a portion of the cover member 106 has been cut away to illustrate a preferred configuration of the inner surfaces 125 of the opening 124 in the post 122.

Referring again to FIG. 1, the bobbin winding assembly 104 of the pot core transformer 100 has primary and secondary windings 126 wound about a bobbin 130 in a well known manner. The bobbin 130 defines an opening 132 that is at the center of the bobbin 130 and extends through the length of the bobbin 130. Two contact members 134*a* and 134*b* are attached to the bobbin 130 which extend in a straight line which is tangential to the bobbin 130 in the embodiment shown in FIG. 1. A plurality of pins 136 is attached to the mounting members 134 with wires 140 which connect the pins 136 to the primary and secondary windings 126 in a well known manner.

FIG. 1 illustrates that the base member 102 also defines a generally toroidal channel 142 which is configured to receive the bobbin 130 of the bobbin winding assembly 104. In particular, the base member 102 includes two curved lips 146*a* and 146*b* which extend perpendicularly outward from an inner surface 144 of the base member 102. The curved lips 146*a* and 146*b* also terminate in generally flat outer mating surfaces 150*a* and 150*b*, respectively. The curved lips 146*a* and 146*b* are terminated so as to define two openings 152*a* and 152*b* that are sized to receive the mounting members 134*a* and 134*b* of the bobbin winding 104 in the manner that is described in greater detail in reference to FIG. 4 below.

A cylindrical post 154 is also formed on the inner surface 144 of the base member 102 so as to be positioned at the approximate center of the base member 102. The post 154 extends outward from the inner surface 144 of the base member and terminates in a generally flat mating surface 156. An opening 160 is formed in the flat surface 156 of the post 154 and the opening 160 is preferably positioned at the center of the cylindrical post 154.

Figure 3:
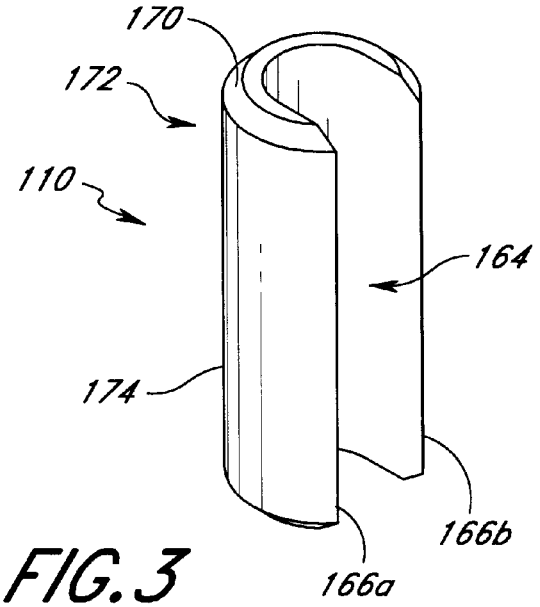
FIG. 3 is a perspective view of a compressible alignment member of the electronic device of FIG. 1.

The alignment member 110 is shown in both FIG. 1 and FIG. 3. Specifically, the alignment member 110 is a generally cylindrical member that has a cross-sectional area that is greater than the cross-sectional area of the openings 124 and 160 in the posts 122 and 154, respectively. The alignment member 110 has a notch 164 which extends along the entire length of the alignment member 110 so that two edges 166*a* and 166*b* of the alignment member 110 are separated from each other along the full length of the alignment member 110. The alignment member 110 includes a beveled surface 170 at the upper end 172 of the alignment member 110. The beveled surface 170 facilitates positioning of the upper end 172 into the opening 124 in the cover member 106 in a manner that will be described in greater detail below.

Figure 4:
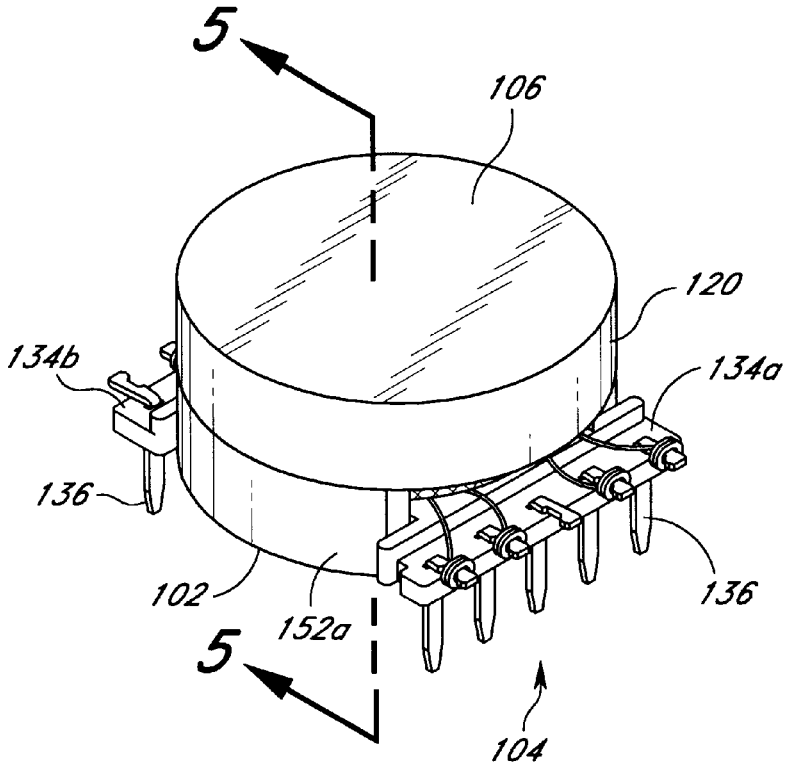
FIG. 4 is an assembled perspective view of the electronic device of FIG. 1.

FIG. 4 illustrates the pot core transformer 100 in its assembled state. The bobbin winding assembly 104 is positioned in the base member 102 so that the mounting members 134*a* and 134*b* extend outward through the openings 152*a* and 152*b*. The cover 106 is also mounted on the base member 102 so that the upper portion of the bobbin assembly 104 is covered by the cover member 106. As shown in FIG. 4, the outer mating surface 120 of the lip 116 of the cover 106 preferably flushly mates with the outer mating surfaces 150*a* and 150*b* of the lips 146*a* and 146*b*. An adhesive (not shown) is positioned between the mating surfaces 120 and 150*a*, 150*b* to securely retain the cover 106 on the base member 102 with the bobbin winding assembly 104 positioned in a cavity defined by the toroidal channels 142*a* and 142*b* of the base member 102 and the channel 112 and the cover member 106.

Figure 5:
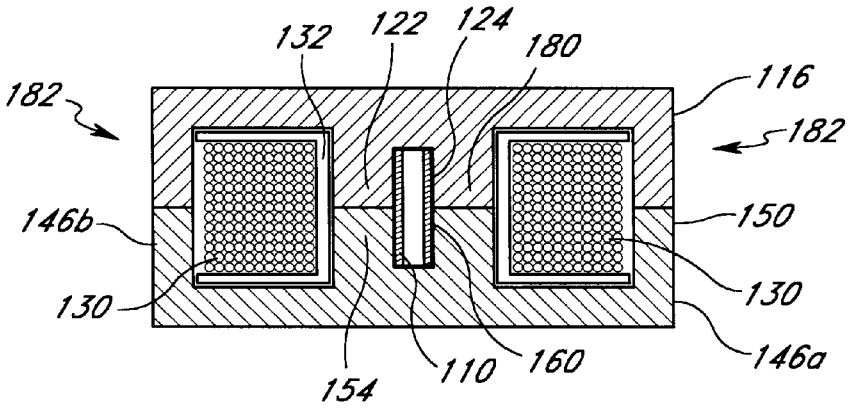
FIG. 5 is a cross-sectional view of the device shown in FIG. 4 taken along the lines 5—5 in FIG. 4.

FIG. 5 is a sectional view of the assembled pot core transformer 100 of FIG. 4. Specifically, as shown in FIG. 5, the bobbin 130 is positioned within the toroidal channels 112 in the cover member 106 and in the toroidal channels 142*a*, 142*b* in the base member 102. The post 122 of the cover member 106 and the post 154 of the base member 102 are positioned within in the opening 132 of the bobbin 130 so that the mating surface 123 of the cover member post 122 is positioned flush against the mating surface 156 of the post 154. The posts 122 and 154 thereby define a center of the core 180 of the pot core transformer 100.

As shown in FIG. 5, the post 122 and the post 154 have identical circumferences and are preferably aligned so that the cross-sectional area of the core 180 is substantially uniform throughout the entire opening 132 of the bobbin 130. Similarly, the curved outer lips 146*a* and 146*b* of the base member 102 preferably have the same contours and dimensions as the outer lip 116 of the cover 106 so that the outer surface 120 of the lip 116 flushly mates with the outer surface 150 of the curved lips 146*a* and 146*b* in the manner shown in FIG. 5. Hence, the outer perimeter of the device 100 is preferably substantially aligned along the entire perimeter of the lips 146*a* and 146*b* in the manner shown in FIG. 5.

The alignment member 110 is adapted to ensure that the cover member 106 can be mounted on the base member 102 so that both the two posts 122 and 154 comprising a center of the core 180 and the lip 120 and lips 146*a*, 146*b* are substantially aligned. In the preferred embodiment, the core of the transformer that transmits flux between the windings is comprised of both the cover member 106 and the base member 102. It will be appreciated, however, that a significant portion of the flux is transmitted via the center of the core 180 comprised of the posts 122 and 154. Hence, as will be described in greater detail below, alignment of the posts 122 and 154 is therefore important to ensure the device 100 has an inductance value that is within a desired tolerance.

In particular, the alignment member 110 has a cross-sectional area which is slightly greater than the cross-sectional area of the opening 124 of the cover member 106. However, the beveled surface 170 at the upper end 172 of the alignment member 110 allows the assembler to position the beveled surface 170 of the alignment member 110 in the opening 124. The alignment member 110 is preferably made of a compressible material so that urging the cover member 106 toward the base member 102 results in the inner walls 125 (FIG. 1) of the opening 124 compressing the alignment member 110 while allowing the alignment member 110 to be positioned in the opening 124.

Specifically, the edges 166*a* and 166*b* (FIG. 3) of the alignment member 110 are urged towards one another as a result of the alignment member 110 being positioned within the opening 124. Hence, the alignment member 110 allows for the cover member 106 to be press fit onto the alignment member 110. As the alignment member 110 is preferably made of a resilient material, the edges 166*a* and 166*b* are urged apart due to the resiliency of the material comprising the alignment member 110. This helps to secure the cover member 106 in the proper alignment with the base member 102 so that the posts 122 and 154 are substantially aligned to define the center of the core 180 having the substantially uniform cross-sectional area along the length of the center of the core 180.

In the preferred embodiment, the alignment member 110 is beveled at either end and the opening 124 in the cover member 106 has the same nominal cross-sectional area as the opening 160 in the base member 102. However, the manufacturing tolerances of the openings 124 and 160 in the posts 122 and 154 may result in the openings 124 and 160 having cross-sectional areas that are slightly larger or smaller than the nominal cross-sectional area for the openings. If the alignment member 110 had a fixed cross-sectional area, there would also be additional manufacturing tolerances that could result in the cross-sectional area of one or both of the openings 160, 124 being greater than the cross-sectional area of the alignment member 110. This could result in slight misalignment of the post 122 with respect to the post 154 and the lips 120 with respect to the lips 146*a* and 146*b* thereby affecting the inductance of the device.

To address this particular problem, the alignment member 110 of the preferred embodiment is oversized with respect to the openings 124 and 160 by an amount that is preferably equal to the manufacturing tolerance of the openings 124 and 160. Since the alignment member 110 has the bevelled surface 170 and is compressible it is therefore configured to be positioned into the smaller openings 124 and 160. In at least one of the openings 124 and 160, the alignment member 110 will be compressed and the outer surface 174 of the alignment member 110 will be positioned flushly in contact with the inner walls 125 or 161 of the openings 160 or 124. The possibility of misalignment of the base member 102 and the cover member 106 as a result of a gap between the alignment member 110 and the inner walls of at least one of the openings 124 or 160 is thereby reduced. Consequently, pot core transformer devices 100 of the preferred embodiment will have less variation from the desired or nominal inductance as at least one source of possible misalignment and alteration of the cross-sectional area of the core has been reduced.

It will be appreciated from the foregoing that the assembly of the pot core transformer 100 of the preferred embodiment is simplified as compared to the prior art pot core transformers as there is no need to bolt the cover member to the base member during assembly. To assemble the pot core transformer 100 of the preferred embodiment, the assembly member 110 is initially positioned in the opening 160 of the base member 102. The bobbin winding assembly 104 is then positioned in the toroidal channels 142*a* and 142*b* with the mounting members 134*a* and 134*b* extending out of the openings 152*a* and 152*b*. The cover member 106 is then positioned on the base member 102 so that the alignment member 110 is positioned in the opening 124. Lastly, an adhesive is applied to the mating surfaces between the base member 102 and the cover member 106 to secure the cover member 106 and the base member 102 together.

Further, as the alignment member 110 ensures better alignment between the posts 122 and 154 that comprise the center of the core 180 and the outer lips 120 and 146*a*, 146*b*, the cross-sectional area of the core is substantially uniform throughout the opening in the bobbin winding. Hence, the inductance of the pot core transformer of the preferred embodiment is a known quantity that is significantly more likely to be within the tolerances of the device. Further, as there is no hole on the upper surface of the cover member, the pot core transformer can be more easily grasped by a vacuum assembly system thereby simplifying the assembly of circuit boards incorporating pot core transformers. Preferably, the outer surfaces of the lip and the posts of both members are machined to fairly close tolerances so that the cover member can be positioned on the base member and the members can be secured together in a generally uniform fashion. Hence, the pot core transformers of the preferred embodiment are easier to assemble and will result in a pot core transformer that has an inductance value that is within a closer tolerance of the desired inductance value.

It will be appreciated that the exact dimensions and configuration of the components comprising the device 100 will vary depending upon the application. In one application, both the base member 102 and the cover member 106 are made of a ferrite material and the alignment member 110 is made of a deformable plastic such as Rynite FR530. In this particular application, the base member 102 and the cover member 106 have been selected so as to form a 2311 Ferrite touchtone core with an air gap having an inductance factor of 833 nH/T2±5%. The base member 102 is approximately 0.60±0.01 inches in width with the openings 152*a* and 152*b* being approximately 0.531±0.020 inches long. The lips 146 and the post 154 are approximately 0.150±0.005 inches high. The post 154 has a diameter of approximately 0.382±0.008 inches and the opening 160 has an approximate diameter of 0.097±0.002 inches. The cover member 106 has an outer diameter of 0.895+0.023−0.024 inches and the lip 116 has an inner diameter of approximately 0.720+0.013−0.012 inches and the dimensions of the post 122 and opening 124 are identical to the post 154 and the opening 160 of the base member 102. These dimensions are simply illustrative of one application of the device 100 of the preferred embodiment. Different dimensions and materials can be used to make a device of the present invention without departing from the spirit of the present invention.

Hence, although the foregoing description of the preferred embodiment of the present invention has shown, described and pointed out the fundamental novel features of the invention, it will be understood that various omissions, substitutions, and changes in the form of the detail of the apparatus as illustrated as well as the uses thereof, may be made by those skilled in the art without departing from the spirit of the present invention. Consequently, the scope of the invention should not be limited to the foregoing discussion, but should be defined by the appended claims.

What is claimed is:

1. An electrical device comprising:

a first monolithic member having a smooth, uninterrupted top surface, the first member defining a first channel and having a first post which terminates in a first outer surface opposite the top surface, wherein a first blind hole is formed in the first outer surface of the first member;

a second monolithic member that defines a second channel and has a second post that terminates in a second outer surface wherein a second blind hole is formed in the second outer surface of the second member;

a magnetic element winding that is configured to be positioned within a cavity defined by the first and second channels when the first member is positioned adjacent the second member in a first orientation; and an alignment member which has a first cross-sectional area greater than the cross-sectional area of the first blind hole in the first member and is compressible to a second cross-sectional area less than or equal to the cross sectional area of the first blind hole, the alignment member having an axis and a first and a second end wherein the first end of the alignment member is positioned in a mating relationship with the first member and wherein the second end of the alignment member is positioned in a mating relationship with the second member so that the first and second posts are positioned in a fixed relationship to each other to thereby define at least a portion of a core for the magnetic element positioned in the cavity when the first and second members are positioned in the first orientation with respect to each other;

further wherein the second member may be in any angular orientation about the axis of the alignment member when the first and second members are positioned in the first orientation.

2. The device of claim 1, wherein the outer surfaces of the first post and the second post have a first desired cross-sectional area and wherein the alignment member orients the first and second members with respect to each other in the first orientation so that the cross-sectional area of the core in a location adjacent the interface between the first and second outer surface is substantially equal to the first desired cross-sectional area.

3. The device of claim 1, wherein the alignment member is comprised of a cylindrical shaft that is split so as to define two edges that are spaced from each other and wherein the alignment member is configured to compress so that the edges are urged closer to each other when the alignment member is positioned within the first blind hole.

4. The device of claim 3, wherein the first blind hole is formed so as to have a first actual cross-sectional area that is within a first tolerance value of a nominal first cross-sectional area and wherein the alignment member is formed so as to have a second cross-sectional area in an uncompressed state that is at least equal to the nominal first cross-sectional area plus the first tolerance value so that when the first end of the alignment member is positioned in the first blind hole, the alignment member is touching the inner walls of the first blind hole in the compressed state thereby reducing misalignment of the first member with respect to the second member in the first orientation as a result of a gap between the alignment member and the inner walls of the first blind hole.

5. The device of claim 1, wherein the first and second members have lips positioned on the outer perimeter of the first and second members and wherein the lips are terminated in mating surfaces so that when the first and second surfaces are positioned in the first orientation with respect to each other, the lips are in contact with each other so that the application of an adhesive on the mating surface will retain the first and second members in the first orientation.

6. The device of claim 5, wherein the winding is mounted on a bobbin that defines a cylindrical opening and wherein the winding is positioned in the channels of the first and second members so that a portion of the core comprised of the first and second posts are positioned within the cylindrical opening of the winding.

7. The device of claim 6, wherein the cross-sectional area of the portion of the core comprised of the first and second posts is substantially uniform throughout the cylindrical opening when the first and second members are held in the first orientation by the alignment member.

8. A pot core transformer comprising:

a base member that defines a first channel and has a first post of a first cross-sectional area wherein the first post terminates in a first outer surface and wherein a first blind hole is formed in the first outer surface of the first post;

a monolithic cover member having a smooth uninterupted top surface, said cover member defining a second channel and having a second post of the first cross-sectional area wherein the second post terminates in a second outer surface and wherein a second blind hole of a second cross sectional area is formed in the second outer surface of the second post;

a toroidal winding which defines a central opening wherein the toroidal winding is positioned within a cavity defined by the first and second channels when the first member is positioned adjacent the second member in a first orientation; and an alignment member having an axis and a first and a second end, the second end being compressible between a maximum cross-sectional area greater than the second cross-sectional area and a minimum cross-sectional area less than or equal to the second cross-sectional area of the second blind hole wherein the first end of the alignment member is positioned within the first blind hole of the first post and wherein the second end of the alignment member is positioned within the second blind hole on the second post so that the first outer surface and the second outer surface of the first and second posts are positioned in a fixed relationship with respect to each other to define at least a portion of a core for the toroidal winding wherein the portion of the core is positioned in the central opening of the toroidal winding when the first and second members are in the first orientation and wherein the outer surfaces of the alignment member are in contact with the inner surfaces of the second opening when the alignment member is positioned within the second opening to thereby reduce misalignment between the first and second posts as a result of a gap between the alignment member and the inner surfaces of said second opening;

further wherein the cover member may be in any angular orientation about the axis of the alignment member when the first and second members are positioned in the first orientation.

9. The transformer of claim 8, wherein the outer surface of the first post and the outer surface of the second post have a first desired cross-sectional area and wherein the alignment member orients the base and cover members with respect to each other so that the cross-sectional area of the portion of the core in the central opening of the toroidal winding is substantially uniform.

10. The transformer of claim 8, wherein the alignment member is comprised of a cylindrical shaft that is split so as to define two edges that are spaced from each other and wherein the alignment member is configured to compress so that the edges are urged closer together when the alignment member is positioned within the second blind hole.

11. The transformer of claim 10, wherein the second blind hole is formed so as to have a first actual cross-sectional area that is within a first tolerance value of a nominal first cross-sectional area and wherein the alignment member is formed so as to have a second cross-sectional area in an uncompressed state that is at least equal to the nominal first cross-sectional area plus the first tolerance value so that when the second end of the alignment member is positioned in the second blind hole, the alignment member is touching the inner walls of the first blind hole in the compressed state thereby reducing misalignment of the cover member with respect to the base member in the first orientation as a result of a gap between the alignment member and the inner walls of the second blind hole.

12. The device of claim 8, wherein the base and cover members have lips positioned on the outer perimeter of the base and cover members respectively and wherein the lips are terminated in mating surfaces so that when the base and cover members are positioned in the first orientation with respect to each other, the lips are in contact with each other so that the application of an adhesive will retain the base and cover members in the first orientation.

13. The device of claim 12, wherein the winding is mounted on a bobbin that defines a cylindrical opening and wherein the winding is positioned in the channels of the base and cover members so that the core comprised of the first and second posts is positioned within the cylindrical opening of the winding.

* * * * *